United States Patent [19]

Gannett

[11] 3,944,744

[45] Mar. 16, 1976

[54] MATRIX CODING SECRET SIGNALLING SYSTEM

[75] Inventor: Danforth K. Gannett, Mountain Lakes, N.J.

[73] Assignee: Bell Telephone Laboratories, Incorporated, Murray Hill, N.J.

[22] Filed: May 10, 1945

[21] Appl. No.: 592,962

[52] U.S. Cl. ..... 179/1.5 R

[51] Int. Cl.[2] ..... H04K 1/02

[58] Field of Search..... 250/27 GT, 27 CC; 178/1.5, 178/22; 179/1.5 R

[56] References Cited

UNITED STATES PATENTS

| | | | |
|---|---|---|---|
| 2,136,441 | 11/1938 | Karolus | 250/27 |
| 2,195,864 | 4/1940 | Knoup | 250/27 |
| 2,308,778 | 1/1943 | Prince | 250/27 |

*Primary Examiner*—Malcolm F. Hubler
*Assistant Examiner*—H. A. Birmiel
*Attorney, Agent, or Firm*—H. A. Burgess

EXEMPLARY CLAIM

1. In a scrambling system for translating input message values into output currents of substantially random occurrence of values, separate message input circuits for each message value, separate output control circuits for determining each output current value, a plurality of key circuits crossing said message input circuits, means to apply key currents to respective key circuits on a substantially random basis, and means at each cross-over point between said message input circuits and key circuits for setting up a current condition in a corresponding one of said output control circuits to determine the value of output current.

8 Claims, No Drawings

INVENTOR
D. K. GANNETT

BY H. A. Burgess

ATTORNEY

INVENTOR
D. K. GANNETT

BY H. A. Burgess

ATTORNEY

INVENTOR
D. K. GANNETT

BY H. A. Burgess
ATTORNEY

INVENTOR
D. K. GANNETT

BY H. A. Burgess

ATTORNEY

MATRIX CODING SECRET SIGNALLING SYSTEM

The present invention relates to translating or combining circuits for selectively setting up in individual outgoing circuits current conditions under the conjoint control of currents in a plurality of different input circuits.

The invention, while of broad and general application, will be disclosed herein as embodied in a scrambling or enciphering circuit for use in secret signaling whereby signal currents are changed into enciphered currents under control of key currents prior to transmission, and a reverse transformation is made at the receiving point under control of duplicate key currents thereat. In this embodiment the signal and key currents each have any of a definite number of values and a separate circuit is provided for each value of signal current as well as for each value of key current. These sets or groups of signal and key conductors afford a number of control points equal to the product of the numbers of conductors in the conductor groups. At these control points, individual control devices are used for responding to the simultaneous application of signal and key currents and in so responding, exercise a selective control upon an output terminal or conductor. In the case of an enciphering circuit where it is desired to produce the same number of output current values as the number of discrete signal current values employed, these control devices are associated in groups so that any device of a group sets up the same value of output current, there being as many such groups as there are separate values of output current. Such a combination is referred to as a permuter.

The general object of the invention is to set up in individual outgoing circuits definite current conditions as determined at each instant by the conjoint application to suitable control devices of currents in individual conductors belonging to each of a plurality of sets or groups.

In the specific embodiment disclosed herein, the signal is first changed to stepped form and a separate circuit is provided for each step value. Likewise the key currents are either generated in steps or converted to stepped form and a separate circuit is provided for each step value. If a single key is used, a two-dimensional scramble results in which the key value conductors may be thought of as, say, vertical and the signal value conductors as horizontal with the two classes of conductors crossing each other and affording cross-overs equal in number to the product of the numbers of conductors in the two classes. At each cross-over point is a device which responds only to application of a current in each of the intersecting conductors at such point.

More than one set of key conductors can be used for a set of signal value conductors, with the same responsive devices responding to the signal current and to a plurality of key currents. If two sets of key conductors are used, for example, the number of cross-over points is the product of three factors, namely, the number of signal value conductors and the numbers of key value conductors representing the two keys. In this case a three-dimensional scramble is produced and the physical arrangement of the conductor groups can be thought of as in three planes mutually at right angles to one another with the points of intersection falling within a cube or other rectilinear solid.

As will appear more fully from the disclosure a plurality of scramblers or permuters will commonly be used in tandem in the same signal path.

The invention will be more fully understood from the following detailed description in connection with the accompanying drawings in which.

Figure 1:
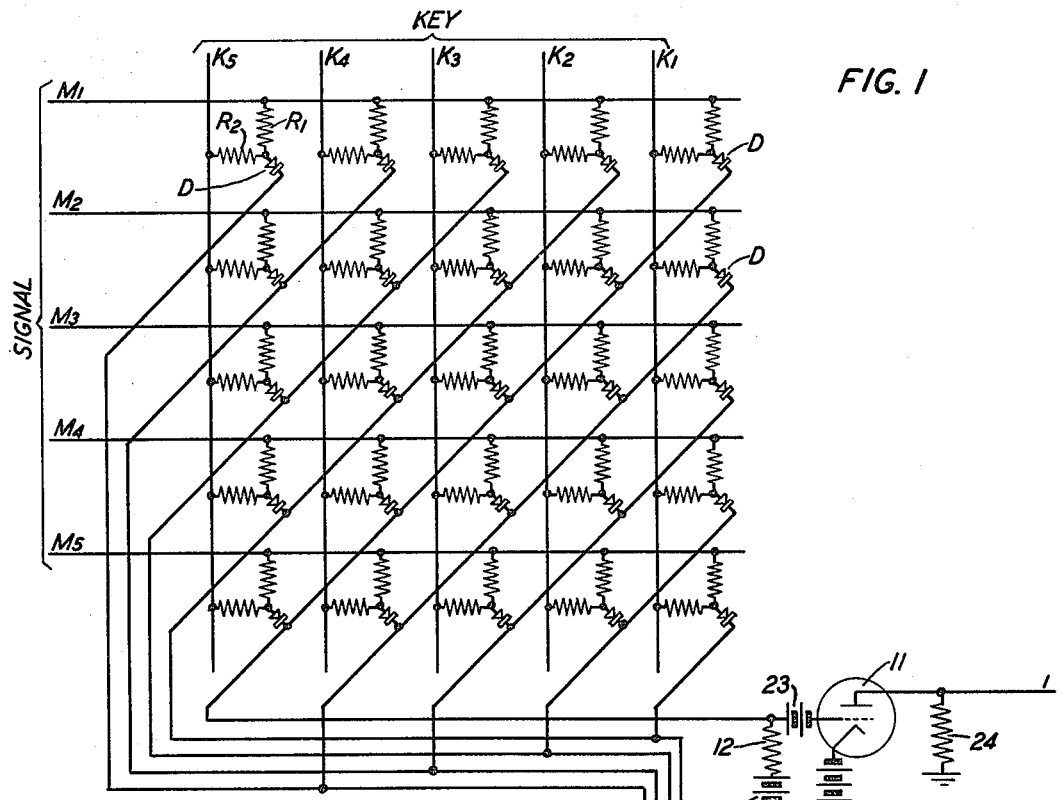
FIG. 1 is a schematic circuit diagram of one type of permuter circuit according to the invention.
Figure 5:
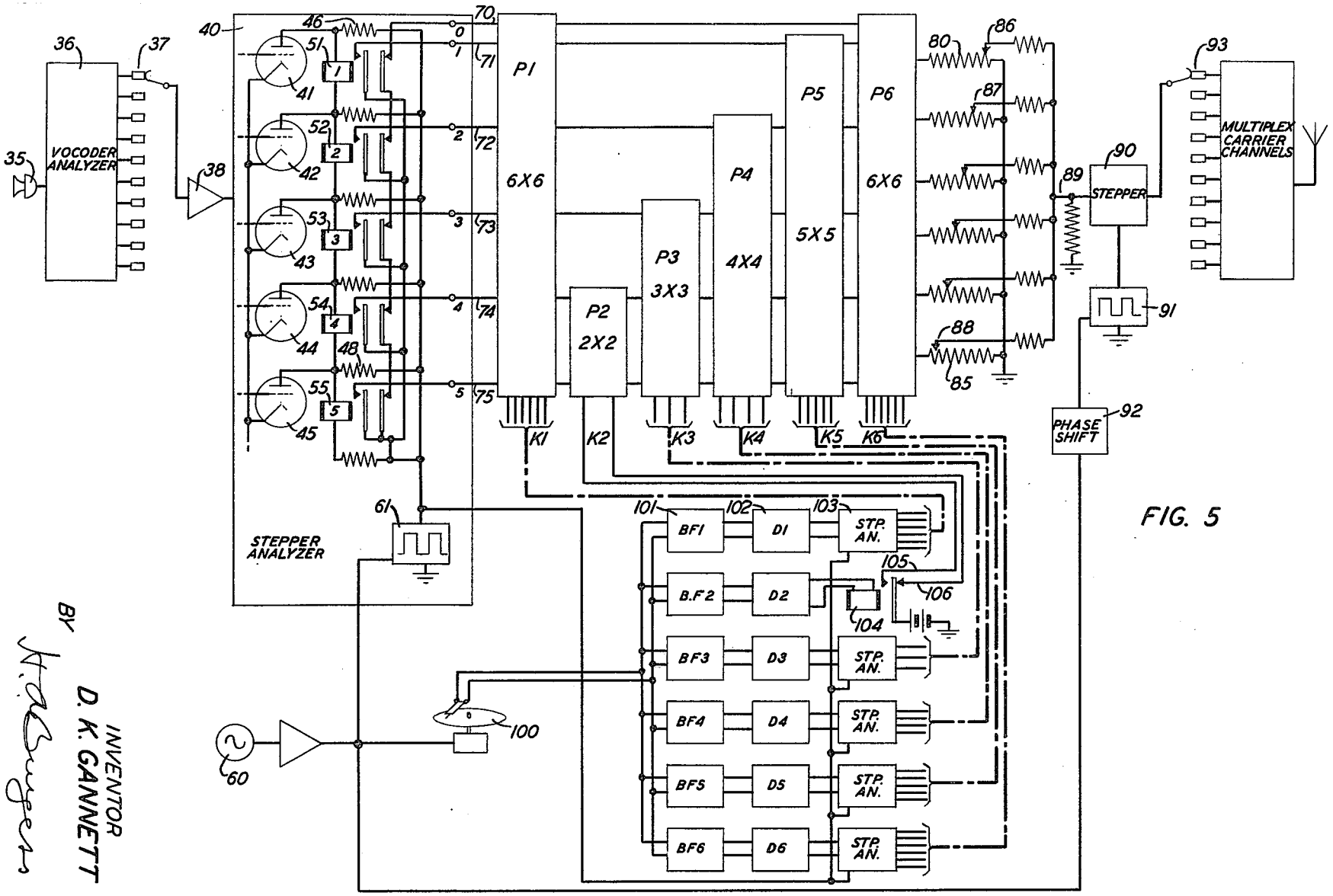
FIG. 5 is a block schematic diagram of a complete transmitting station of a secret telephone system according to the invention, using permuters of the type illustrated in FIG. 1.

Referring first to FIG. 1, the signal or message leads are shown at the left and the key leads at the top of the figure. Each message leads M1, M2, etc. is assumed to be associated with suitable signaling equipment (one type of which is illustrated in FIG. 5) which is adapted to impress positive voltage on the individual leads relative to ground. Similarly, positive voltage is impressed on the individual key leads. Since in this illustration there are five leads in each group, there are twenty-five points of intersection. At each such point there is a current or voltage responsive device D which may be a copper oxide rectifier, a diode or other tube, relay, thermistor or similar device capable of responding only to impressed voltage above a predetermined minimum which can be determined by aid of a bias. In the figure it is assumed that the devices D are copper oxide rectifiers. Each device has one of its terminals connected to a pair of high resistances $R_1$ and $R_2$ of which $R_1$ is connected to the respective message lead and $R_2$ is connected to the respective key lead.

The relation is such that when only the voltage from one of these leads is impressed, the device remains non-conducting on account of its characteristic aided by the bias derived from battery 10 associated with one of the output amplifier tubes 11; but when voltage from both an M lead and a K lead are simultaneously applied through $R_1$ and $R_2$ to the same device, the bias is overcome and the device is changed to its low resistance condition so that current is sent to ground through a grid resistor 12 against the voltage of the bias battery 10.

Figure 2:
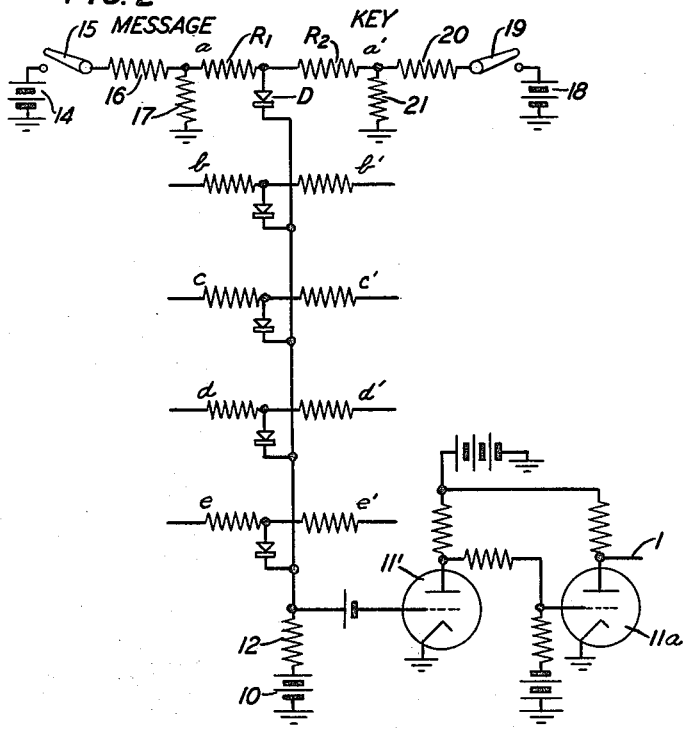
FIG. 2 is an explanatory diagram to illustrate voltage conditions which may exist in the circuit of FIG. 1.

This is further illustrated in FIG. 2 where the message voltage is indicated as applied from a battery 14 when switch 16 is closed, the resistance $R_1$ being connected to a point *a* in a potential divider circuit consisting of resistors 16 and 17 in which the value of resistor 17 is low compared with that of the series resistances. Similarly, the key voltage is applied from battery 18 through switch 19 and potential divider circuit 20, 21 of which point *a'* is connected to resistor $R_2$. When either switch alone is closed, the voltage applied to D is insufficient to permit current to flow against the voltage of battery 10 but when both switches are closed the voltages add on account of the use of the high resistances in the connecting circuits and the device D becomes conducting and transmits current to the input circuit of tube 11'. Even if voltage should be applied simultaneously to points $b$, $c$, $d$ and $e$ (but not to any of the corresponding primed terminals also), none also) the accompanying devices would be rendered conducting. For a similar reason, only one of the 25 devices D of FIG. 1 can become conducting when one lead of each group has battery applied to it, even though this same voltage is applied to five of the $R_1$ resistors and to five of the $R_2$ resistors, since but one device D receives voltage from both an $R_1$ and an $R_2$ resistor.

It is seen from FIG. 1 that the devices D are connected in groups of five in a diagonal relationship, to the input terminals of the five output tubes 11, etc. In general, the output groups could be connected in any pattern such that no two of the same group appear in the same row or in the same column, but the simple diagonal pattern is shown for illustration.

Each of the output tubes is normally biased beyond cut-off by grid battery 23 so that normally the corresponding one of output leads 1 to 5 is at ground potential. When a device D is caused to transmit current, one of the five output tubes has positive voltage applied to the upper terminal of grid resistor 12 sufficient to overcome the grid bias and allow the tube to conduct current through output coupling resistor 24 which then applies a negative voltage to the output leads 1, 2, etc. Following through the connections it is seen that if input leads M1 and K1 have positive voltage applied to them, output lead 1 is energized. This same effect is produced if the voltages are applied to M2 and K2 or to M3 and K3, etc. Arranging these leads and output conductors in a table, the output lead that is energized is given by the number at the intersection of the rows and columns.

| | K5 | K4 | K3 | K2 | K1 |
|---|---|---|---|---|---|
| M1 | 5 | 4 | 3 | 2 | 1 |
| M2 | 4 | 3 | 2 | 1 | 5 |
| M3 | 3 | 2 | 1 | 5 | 4 |
| M4 | 2 | 1 | 5 | 4 | 3 |
| M5 | 1 | 5 | 4 | 3 | 2 |

This table shows that any output lead can be energized when any input M lead has a voltage applied to it, dependent upon the K lead used. If the K leads are used in a random order, there is an equal probability that a voltage applied to a given M lead will cause energization of any one of the output leads 1 to 5.

Referring again to FIG. 2, the five D devices shown are those belonging to one diagonal group and any one of them when made conducting will cause the tube 11' associated with that group to become conducting. In FIG. 2 the tube 11*a* is so connected to outgoing conductor 1 that a positive voltage is set up on conductor 1 in response to current transmitted through a device D. Normally saturation current flows in tube 11*a* and tube 11' is cut off. When tube 11' conducts in response to actuation of a D device, tube 11*a* is cut off sending the potential of output lead 1 positive. When tube 11' is non-conducting, lead 1 is near ground potential and if desired the small positive voltage then existing on lead 1 can be cancelled by an opposing battery. Depending upon circuit requirements it may be desirable in some cases to connect the output conductors to the output tubes as in FIG. 1 to apply negative voltages thereto while in other cases it may be preferred to connect the output conductors as in FIG. 2 to apply positive voltages to them.

Figure 3:
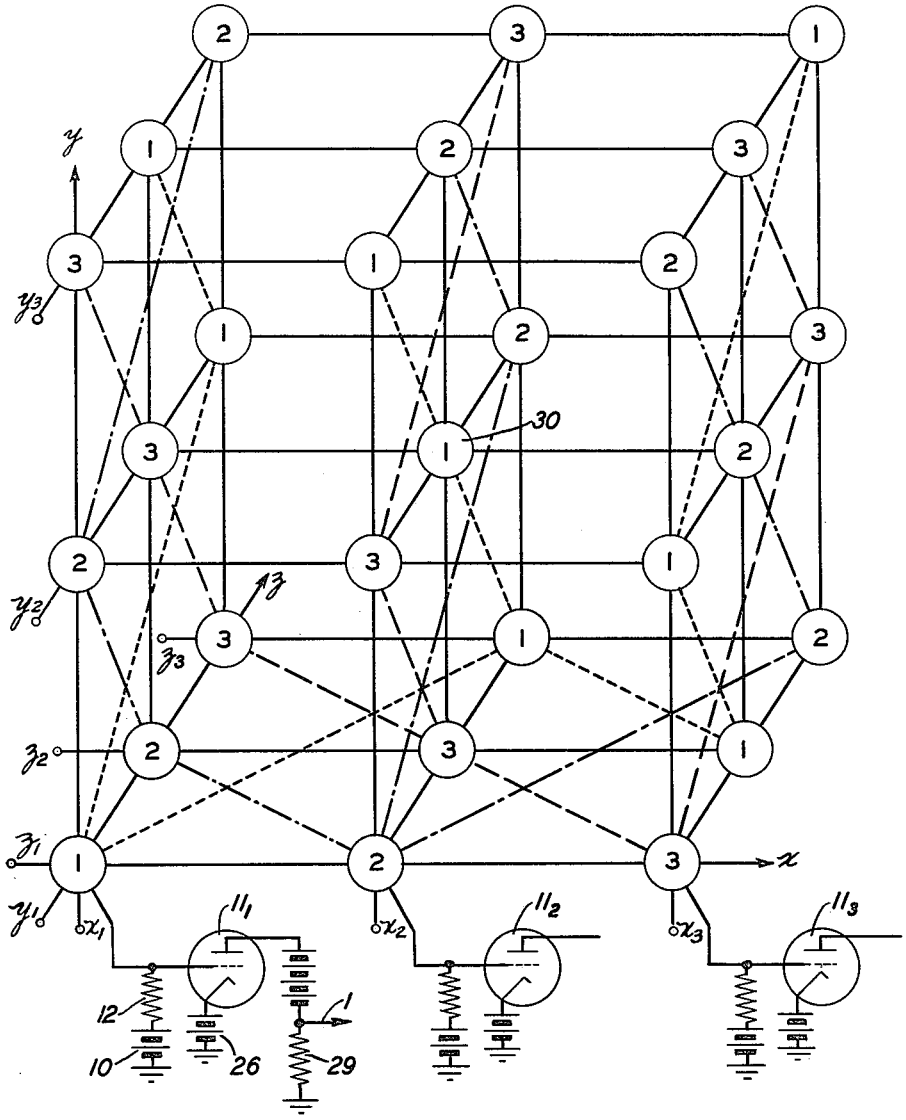
FIG. 3 is a schematic diagram of the circuit arrangement of a three-dimensional permuter according to the invention.
Figure 4:
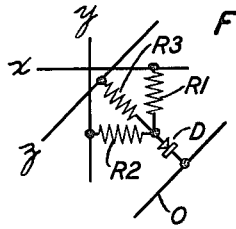
FIG. 4 is a detail view of one of the intersecting points of the system of FIG. 3.

Referring to FIG. 3, three sets of input terminals are shown labeled $x$, $y$ and $z$ with subscripts. Each circle represents a point of intersection and contains the elements shown in FIG. 4, that is, a device D and three resistors $R_1$, $R_2$ and $R_3$ for connecting one terminal of D to respective input leads $x$, $y$ and $z$, and an output conductor $o$. In FIG. 3 the single lead $x_1$ is multiplied to the nine circles shown in the vertical plane that is furthest to the left and extends perpendicular to the paper. Lead $x_2$ is multipled to the nine circles in the next vertical plane to the right, that is, the central plane, while $x_3$ is similarly multipled to the nine circles in the right-hand vertical plane. Lead $y_1$ is multipled to the nine circles in the bottom plane that is perpendicular to the paper, $y_2$ to the nine circles in the next higher or middle horizontal plane and $y_3$ to the nine circles in the top plane. Lead $z_1$ is multipled to the nine circles in the front vertical plane, nearest the reader, lead $z_2$ to the nine circles in the middle vertical plane parallel to the paper and lead $z_3$ to the nine circles in the rear vertical plane. To select the device in the circle numbered 30, for example, it is necessary to apply positive voltage to the three leads $x_2$, $y_2$ and $z_2$. Any one of the 27 devices can be selected by actuating the proper three input leads, one $x$-lead, one $y$-lead and one $z$-lead.

The manner in which the diagonal output groupings of the tubes are made is indicated by the numbers 1, 2 and 3 within the circles and the dotted or broken diagonal lines connecting circles of like number. All of the No. 1 circles are connected to the input of amplifier tube $\mathbf{11}_1$ while the No. 2 circles are all connected to tube $\mathbf{11}_2$ and the No. 3 circles to tube $\mathbf{11}_3$. Thus, there are nine circles in each group connected to any one output tube. In FIG. 3, for illustration, each tube 11 is biased to non-conducting condition by battery 26 in the cathode ground lead, this battery being of such voltage as to make the cathode potential normally positive with respect to the grid. When a device D is switched on, the current flow through resistor 12 makes the grid more positive and causes the tube to conduct current through resistor 29 and apply negative voltage to an outgoing lead such as lead 1. It will be understood that the outgoing leads are each connected to device D as shown by lead $o$ in FIG. 4.

Figure 6:
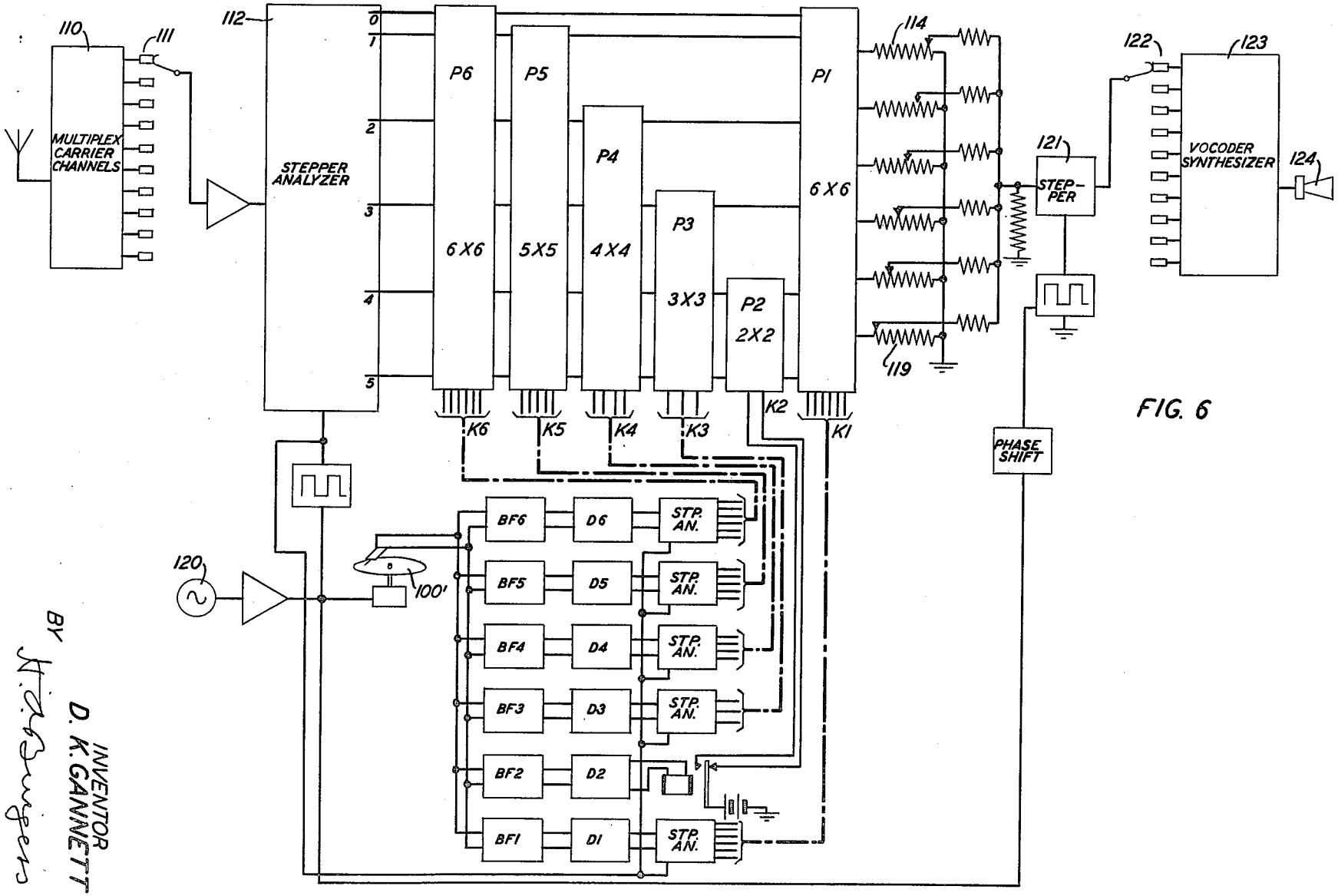
FIG. 6 is a similar diagram of a receiving station that may be used with the FIG. 5 transmitting station.

FIGS. 5 and 6 show how permuters of the type disclosed in FIG. 1 may be applied to respectively the transmitting and receiving stations of a secret telephone system of the general type disclosed in R. L. Miller application Ser. No. 542,975, filed June 30, 1944. In these figures the permuters take the place of the key combining and reentry circuits of the Miller disclosure.

Referring to FIG. 5 the speech input is indicated at 35 by the microphone which can, of course, also be an incoming telephone line. This feeds into the vocoder analyzer 36 which operates in known manner to derive spectrum-defining and pitch-defining low frequency waves from the impressed speech waves, in a number of different paths or circuits each connected to a different distributor point assumed in this instance to be ten in number. The distributor is diagrammatically indicated at 37 as comprising fixed segments over which a brush travels but this representation is intended to be general and to include the relay type of distributor shown by Miller or other equivelent types. The brush is connected through an amplifier 38 to the stepper analyzer 40 which is of the same general type as the message stepper disclosed in the Miller application but additionally includes five relays 51 to 55 which are arranged to be operated one at a time depending upon the strength of the impressed signal. The five stepper tubes 41 to 45 are gas-filled tubes which have their plates supplied with interrupted voltage from pulsing circuit 61 operated under control of standard frequency source 60. The grid circuits of these stepper tubes have different biases applied to them as disclosed by Miller, such that if the signal impressed upon them at a particular instant is of less than a certain amplitude (step 1) none of the stepper tubes fires but if the amplitude is as great as step 1 value or greater one or more of the tubes is fired depending upon whether the amplitude lies between step 1 and step 2, step 2 and step 3, etc.

If the amplitude of the signal at any instant is of less than step 1 value, none of the relays 51 to 55 is energized since none of the stepper tubes is fired. Under these conditions when the pulsing voltage comes on at 61, this voltage is applied over a circuit through the outer armatures and back contacts of all five relays in series to the upper or zero output lead 70 of the stepper analyzer. If the signal is of such strength that only tube 41 fires, relay 51 is energized due to the drop of potential existing through series resistor 46. This breaks the path leading to the zero output lead at the outer armature and back contact of relay 51 and closes a path for applying positive voltage through the inner armature and front contact to output lead 71. If the signal has a value between step 2 and step 3, the two stepper tubes 41 and 42 fire causing relay 52 to become energized. (Relay 51 does not become energized since no difference of potential exists across its terminals.) Relay 52 applies positive voltage to output lead 72. A similar action follows for steps 3, 4 and 5 causing a voltage to be placed on the corresponding output lead 73, 74 or 75. On step 5 all five stepper tubes fire and relay 55 receives energizing current due to the drop of potential across series resistor 48. In this manner the same value of positive potential is applied to one of the six output leads 70 to 75 depending upon the instantaneous amplitude of the signal.

These six leads are connected to input terminals of the first permuter $P_1$ and correspond to the message leads shown in FIG. 1 except that in this case there are six such signal or message leads. There are also six key leads shown at $K_1$ corresponding to the key leads in FIG. 1. It is understood that the permuter $P_1$ may be of the same type as shown in FIG. 1 except that it is a $6 \times 6$ instead of a $5 \times 5$ permuter.

Five other permuters $P_2$, $P_3$, $P_4$, $P_5$ and $P_6$ are also shown having the number of message and key terminals indicated in the drawing. For example, permuter $P_2$ has two message and two key leads, permuter $P_3$ has three message and three key leads, etc. Each of these permuters may be constructed in accordance with the FIG. 1 disclosure.

The final output leads from the permuter $P_6$ connect to ground through potentiometer resistances 80 to 85. It is assumed for convenience that the type of internal connection to the output amplifier tubes in each permuter is of the type shown in FIG. 2 so that positive voltages are used throughout for both the input and output message terminals of the permuter. Thus at each signal interval a positive voltage is applied to some one and one only of the potentiometer resistors 80 to 85, it being understood that the voltage so applied is of the same value in all cases. In order to derive or recover six stepped values of signal having the values 0 to 5 steps, inclusive, contacts are applied at different stepped points along these potentiometer resistances, the uppermost contact 86 deriving a step 0 voltage, the second contact 87 deriving a step 1 voltage and so on down to the final contact 88 which derives a step 5 voltage. These contacts lead through series resistors 80, etc. to a common point 89 in the input circuit of stepper 90.

Stepper 90 is arranged to sample the output pulses from the potentiometers 80 to 85 at about the middle of the pulse and to reproduce the stepped pulses in proper form for transmission. Instead of the potentiometers 80 to 85 and single stepper 90 it would, of course, be possible to use six individual stepper tubes in place of the resistors 80 to 85 with their circuits arranged to deliver the six different values of output current corresponding to 0 to 5 steps.

The stepper 90 is supplied with interrupted voltage pulses from source 91, these pulses being properly timed in relation to those produced in the pulse circuit 61 by being driven from the same master oscillator 60 but in this case through a phase shifting circuit 92 which produces a slight lag in the pulses supplied to the stepper 90.

The output of the stepper 90 or of the individual stepper tubes in case they are used is applied to the brush of output distributor 93, the ten segments of which lead to individual multiplex carrier channels, each of which includes a holding circuit as disclosed in the Miller application. The multiplex carrier channels are assumed to employ respectively different carrier frequencies suitable for simultaneous transmission over the same line or radio channel to the distant station. Provision is made as disclosed more fully in the Miller application for properly timing the distributors 37 and 93 such that the latter lags slightly behind the former by the amount necessary for satisfactory operation.

As already indicated, it is necessary to supply key currents to the key leads of each of the permuters, these permuters requiring different numbers of key leads varying from two to six in the example given. For this purpose six different key currents are simultaneously recorded on the record 100, each key being modulated on a different carrier frequency wave, for example, so as to permit them to be separated by the six band filters shown at 101. The record 100 is driven under control of the master oscillator 60 at a definite and constant speed.

Each key modulated carrier wave is derived through its respective band-pass filter 101 and applied to detector 102 for deriving the key current. Detector 102 is followed by a stepper analyzer 103 in each key channel except the second, this stepper analyzer being equivalent to that shown at 40 and containing the appropriate number of stepper tubes and relays. In the case of the second key channel, since only two key leads are used and since a positive voltage is always to be applied to either one or the other of the two leads, a simplification is indicated consisting merely of the relay 104 following the detector. The key for this channel is recorded merely as an on and off signal. If the key is an on signal the relay 104 is energized and applies positive voltage to the key lead 105 while if the key pulse is off, that is, zero the volage is applied to the alternate key lead 106. The stepper analyzers 103 are operated in synchronism with the stepper analyzer 40 so that the key impulses are applied to and withdrawn from the permuters simultaneously with the signal pulses.

The purpose of using two permuters $P_1$ and $P_6$, each a $6 \times 6$ permuter, is to produce a more uniform distribution of the enciphered signal values when taken over long periods of time. Complete permutation could be obtained if one of these two permuters, for example, $P_1$, were omitted. If the permuters $P_2$, $P_3$ and $P_4$ also were omitted, that is, if only the two permuters $P_5$ and $P_6$ were used only 30 out of the possible 720 permutations would be obtained. The full 720 permutations are, however, obtained by addition of the three smaller permuters $P_2$, $P_3$ and $P_4$, this feature being due to H. Nyquist and being disclosed and claimed in his application Ser. No. 592,968, filed May 10, 1945, now U.S. Pat. No. 2,424,998 of Aug. 5, 1947.

In the receiving station in FIG. 6 the received enciphered signals are received in the receiving multiplex terminal 110 and the detected pulses, corresponding to those impressed on the input terminals of the transmitting multiplex channels of FIG. 5, are applied to the segments of the distributor 111. This distributor operates in synchronism with the distributor 93 at the distant station and applies the received pulses to the stepper analyzer 112 which is similar to the stepper analyzer 40. All of the apparatus in the receiving station including the distributors and the stepper analyzer 112 are timed from the master oscillator 120 thereat which is constructed and arranged similarly to the master oscillator 60 to maintain a highly constant frequency over long periods of time.

Six permuters $P_1$ to $P_6$, which are duplicates of the corresponding permuters of FIG. 5, are connected beginning at the output of stepper analyzer 112 but in reverse order to those at the transmitting station, $P_6$ coming first in this instance and $P_1$ last. The final output of the permuter $P_1$ contains the decoded message pulses corresponding to those impressed upon the permuter $P_1$ at the transmitter. These are converted to stepped value pulses by the potentiometer resistors shown at 114 to 119 which are arranged similarly to those at the transmitter to apply stepped value pulses to the output stepper 121. The output pulses from this stepper are applied to the output distributor 122 leading to vocoder synthesizer 123. This part of the circuit may be entirely similar to that disclosed in the Miller application and the final reconstructed speech is applied to the output line or receiver 124.

The circuits for producing the keys are a duplicate of those at the transmitter, the record 100' containing a recording of each of the six keys that are used at the transmitter, this record being a duplicate of the record 100 and stamped from the same master record or recorded in duplicate with the record 100. The various keys are derived as described in FIG. 5 by means of analyzing band filters, detectors and stepper analyzers or, in the case of the second key channel, a relay. In this manner the keys are applied to the permuters in proper timed relation to decipher the received signals.

The manner in which the signals are deciphered at the receiver by permuters which are duplicates of those used at the transmitter can be illustrated by means of a table similar to that given above in connection with the description of FIG. 1. If it be assumed that each permuter is similarly constructed except for the number of input message and key leads and number of output leads, the internal connections for permuters $P_5$ of FIGS. 5 and 6 may be assumed to be made in accordance with the table given above. In the case of the receiver the incoming leads carrying enciphered signals may be called S leads and correspond to the M leads in the above table. The corresponding table for the receiver permuter $P_5$ will then be as follows:

| | K5 | K4 | K3 | K2 | K1 |
|---|---|---|---|---|---|
| S1 | 5 | 4 | 3 | 2 | 1 |
| S2 | 4 | 3 | 2 | 1 | 5 |
| S3 | 3 | 2 | 1 | 5 | 4 |
| S4 | 2 | 1 | 5 | 4 | 3 |
| S5 | 1 | 5 | 4 | 3 | 2 |

where the numbers in the rows and columns refer to the output lead or channel that is energized. It is seen that the internal connections represented in this table duplicate those given in the previous table showing that the transmitting and receiving permuters can be identical.

To test the operation, assume that the message lead used at the transmitter is M1 and the key is K5. These result in a signal being sent out on lead 5, that is, the signal sent is S5. When this is received and when $K_5$ is used, it is seen that output lead 1 is energized giving back M1, the original message. This same result follows for all the other message and key values so long as the identical key is used at the receiver. While in this simple example only a single permuter is assumed, the same rule applies for each permuter and for permuters in tandem when placed in the order given in FIGS. 5 and 6.

The invention is not to be construed as limited to the specific circuits or devices disclosed but its scope is defined in the claims.

What is claimed is:

1. In a scrambling system for translating input message values into output currents of substantially random occurrence of values, separate message input circuits for each message value, separate outputs control circuits for determining each output current value, a plurality of key circuits crossing said message input circuits, means to apply key currents to respective key circuits on a substantially random basis, and means at each cross-over point between said message input circuits and key circuits for setting up a current condition in a corresponding one of said output control circuits to determine the value of output current.

2. A system according to claim 1 in which the means at each cross-over point are connected in groups to respective output control circuits, each group including one such means individual to each message input circuit and to a different one of said key circuits.

3. In a signaling system, means to encipher signals comprising a circuit having a plurality of message terminals and a plurality of key terminals, transmission means for the signals comprising means to apply a voltage to different individual message terminals to indicate different respective signals, means to simultaneously apply a voltage to a given key terminal to indicate the respective key value, individual means in said circuit selectively actuated by the voltages applied to the particular message and key terminals, and a plurality of outgoing circuits each individually controlled by any one of a group of said selectively actuated means, each such group comprising those means selectively actuated by voltages simultaneously applied to any one of said message terminals and a different respective one of said key terminals.

4. In combination, a circuit network having a plural number N of input terminals constituting one group and a plural number M of input terminals constituting a second group, means to apply a voltage to any terminal of the first group and simultaneously to apply a voltage to any terminal of the second group, a number equal to N × M circuit controller devices each connected to receive voltage from only one terminal of each group at a time, an output circuit connection from each of said controllers, a plural number N of output terminals and connections from M different controller output circuits to each of said output terminals, the connections to any one such output terminal leading from only those controllers receiving voltage from a different one of the input terminals of said first group and a different one of the input terminals of the second group.

5. In combination, a circuit network having a plural number of input leads and the same number of output leas, means to apply a voltage to any one of said output leads in response to application of a voltage to any one of said input leads, comprising groups of circuit control devices, each group being adapted to be actuated in common under control of voltage on an individual input lead, each such device when actuated applying voltage in turn to a different one of said output leads, and means to independently apply voltage to said control devices in groups, each of said last groups including but one control device out of any one of said first-mentioned groups, each of said control devices requiring for its actuation application thereto of voltage from one of said input leads and from said last-mentioned means.

6. In a signaling system, a source of signal waves of varying amplitude, a plurality of circuit paths, means selectively responding to signal waves of different amplitude for applying a signal voltage to different ones of said paths one at a time, a second plurality of circuit paths, means to apply key voltage to different ones of said second circuit paths one at a time, a plurality of circuit controllers each adapted to be controlled by application thereto of a signal voltage and a key voltage together, means connecting each of said controllers to receive a signal voltage from one only of said circuit paths of said first plurality and from one only of said circuit paths of said second plurality, for actuating the same, a plurality of output circuit paths each connected to a different group of said circuit controllers, and means causing each circuit controller in a said group when actuated to control current flow in the respective output circuit path.

7. In a signal enciphering circuit, means to subdivide signal waves into stepped waves having amplitudes $S_1$, $S_2$, $S_3$ to $S_n$, a circuit network having $n$ input leads, means operating in response to any of said specified signal wave amplitudes to impress a voltage $v$ on a respective input lead assigned to that signal amplitude, said circuit having $k$ other input leads, means to impress a voltage $u$ on each of said $k$ leads one at a time in fortuitous sequence, a number equal to the product $kn$ of circuit control devices, means to actuate each device only in response to simultaneous application thereto of a voltage $v$ and a voltage $u$ received from one of said $n$ input leads and one of said $k$ input leads, respectively, a plurality of output leads, $n$ in number, means to produce a voltage change in an individual output lead in response to actuation of any one of a plurality of said circuit control devices actuated from different input leads, an outgoing circuit and means to translate said voltage changes in said several output leads into stepped amplitudes of voltage in said outgoing circuit, each step being proportional to one of the amplitudes $S_1$, $S_2$, $S_3$ to $S_n$.

8. A secret telephone system comprising means to derive from input speech waves in a plurality of separate circuit paths a plurality of low frequency speech-defining currents, a stepper analyzer having a plurality of output leads and including means for applying a voltage to one of said leads at a time depending upon the instantaneous value of the respective speech-defining current, a permuter circuit having a signal input lead for each of said stepper analyzer output leads and respectively connected thereto, said permuter circuit having a plurality of input key leads, means to apply voltage to individual input key leads, said permuter having output terminals corresponding in number to said signal input leads, and means for applying voltage to individual output terminals selectively under the joint control of voltage applied to one of said signal input leads and voltage applied to one of said input key leads, an outgoing circuit from said permuter circuit and means for translating voltages on said output terminals into voltages of respectively different magnitude and impressing the same upon said outgoing circuit.

* * * * *